US008004416B2

(12) United States Patent
Bradley, Jr. et al.

(10) Patent No.: US 8,004,416 B2
(45) Date of Patent: Aug. 23, 2011

(54) SMOKE ALARM SYSTEM

(76) Inventors: Arch C. Bradley, Jr., Conway, AR (US); Cindy A. Bradley, Conway, AR (US)

( * ) Notice: Subject to any disclaimer, the term of this patent is extended or adjusted under 35 U.S.C. 154(b) by 341 days.

(21) Appl. No.: 12/380,093

(22) Filed: Feb. 24, 2009

(65) Prior Publication Data

US 2009/0237260 A1 Sep. 24, 2009

Related U.S. Application Data

(60) Provisional application No. 61/069,871, filed on Mar. 18, 2008.

(51) Int. Cl.
*G08B 17/10* (2006.01)

(52) U.S. Cl. ..... 340/628; 340/693.6

(58) Field of Classification Search ..... 340/693.6, 340/693.11, 628–632, 693.5, 693.9, 693.12, 340/691.1, 500
See application file for complete search history.

(56) References Cited

U.S. PATENT DOCUMENTS 4,329,681 A * 5/1982 Parsons ..... 340/545.6
4,980,672 A 12/1990 Murphy
5,149,038 A 9/1992 VanCleve
5,432,500 A * 7/1995 Scripps ..... 340/628
5,563,766 A 10/1996 Long et al.
5,577,696 A 11/1996 Kramer
6,644,617 B2 11/2003 Pitlor
6,859,146 B2 2/2005 McGreal et al.

* cited by examiner

*Primary Examiner* — Anh V La
(74) *Attorney, Agent, or Firm* — Ray F. Cox, Jr.

(57) ABSTRACT

A smoke alarm system having a base and a body. The base is mounted onto and electrically connected to an unswitched electrical box. The body contains conventional smoke alarm circuitry. The base contains a threaded female socket similar to a standard light bulb socket. The body contains a corresponding male threaded connector similar to that on a standard light bulb. The body is thus able to be electrically connected to as well as physically mounted to the base by simply screwing the male threaded connector into the female threaded socket in the same manner as a light bulb is screwed into a light socket. The base is installed on the ceiling with its wires extending into the unswitched electrical box. A metal ring on the bottom shoulder of the base is connected to the smoke alarm interconnect system. On top of the body are two metal spring-loaded tabs which are connected within the smoke alarm to its interconnect system. As the male portion of the unit is screwed into place these metal tabs make connection with the metal shoulder on the female portion of the unit completing the interconnect circuit. A light bulb changing device on a handle may be used to remove and reinstall the units while standing on the floor.

3 Claims, 6 Drawing Sheets

SMOKE ALARM SYSTEM

CROSS-REFERENCE TO RELATED APPLICATIONS

This application claims the benefit of U.S. Provisional Patent Application No. 61/069,871 filed Mar. 18, 2008, the disclosure of which is incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention relates to smoke alarms and similar devices, and in particular, to such devices that may be easily removed for servicing and reinstalled.

2. Brief Description of the Related Art

The smoke alarms now used in homes and businesses are difficult to service. In order to change or test the battery, install or reinstall the alarm, a ladder must generally be used. In addition, some knowledge of the mechanics of the smoke alarm is required. Smoke alarms may not be properly maintained because of the inconvenience and the lack of knowledge of the mechanical operation of the alarm. The elderly or disabled may be physically unable to service their smoke alarms.

The limitations of the prior art are overcome by the present invention as described below.

BRIEF SUMMARY OF THE INVENTION

The present invention comprises a smoke alarm system comprising a base and a body. The base is mounted onto and electrically connected to a standard ceiling electrical box. The power supply to the electrical box is not switched. In other words, electrical power is supplied continuously to the base and cannot be inadvertently switched off, thereby defeating the alarm function. The body contains conventional smoke alarm circuitry.

The base contains a threaded female socket similar to a standard light bulb socket. The body contains a corresponding male threaded connector similar to that on a standard light bulb. The body is thus able to be electrically connected to as well as physically mounted to the base by simply screwing the male threaded connector into the female threaded socket in the same manner as a light bulb is screwed into a light socket. The present invention can therefore be serviced as easily as changing a light bulb.

The base is installed on the ceiling with its wires extending into the unswitched electrical box. A metal ring on the bottom shoulder of the base is connected to the smoke alarm interconnect system. On top of the body are two metal spring-loaded tabs which are connected within the smoke alarm to its interconnect system. As the male portion of the unit is screwed into place these metal tabs make connection with the metal shoulder on the female portion of the unit completing the interconnect circuit.

A light bulb changing device on a handle may be used to remove and reinstall the units while standing on the floor. The present invention can be installed in such a way as to provide easier and faster servicing of the smoke alarm. It can be serviced with or without the help of a ladder or stepstool, allowing people with disabilities and the elderly to service their own smoke alarms without risking injury by balancing on a chair or another piece of furniture. Homes and commercial buildings can utilize this system in order to be warned in case of a fire without having to deal with the inconvenience and difficulty currently involved in keeping smoke alarms systems serviced.

These and other features, objects and advantages of the present invention will become better understood from a consideration of the following detailed description of the preferred embodiments and appended claims in conjunction with the drawings as described following.

DETAILED DESCRIPTION OF THE INVENTION

Figure 1:
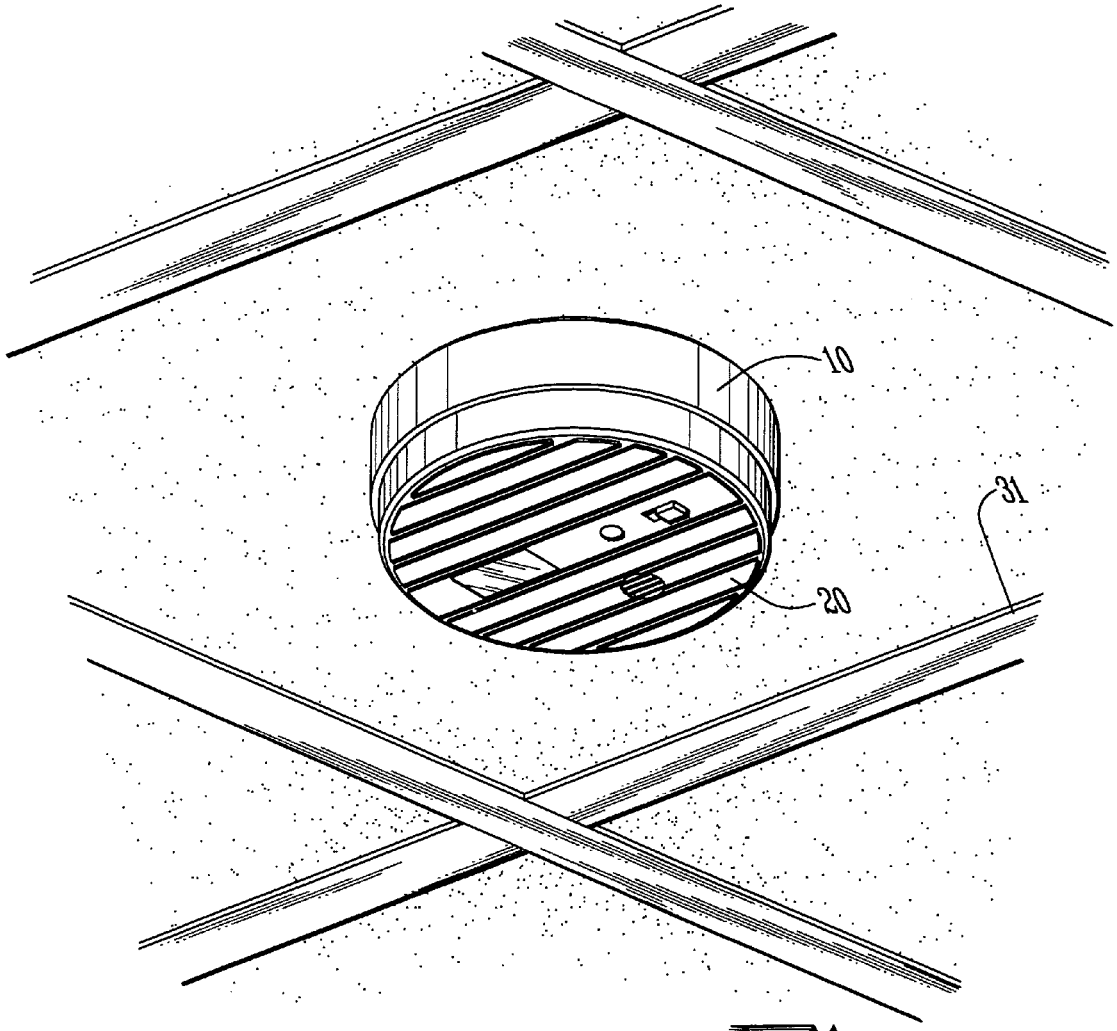
FIG. 1 is a perspective view of one embodiment of the present invention installed on the ceiling of a building.
Figure 2:
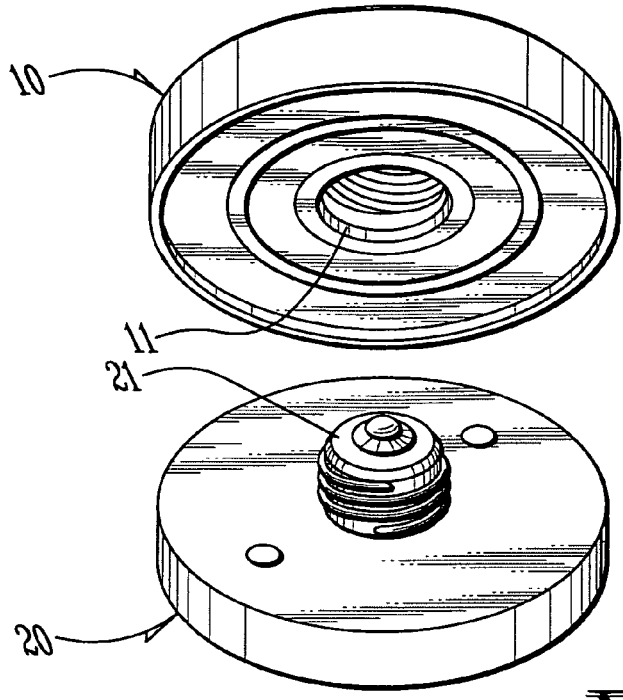
FIG. 2 is an exploded perspective view of the base and body of the embodiment of FIG. 1.
Figure 3:
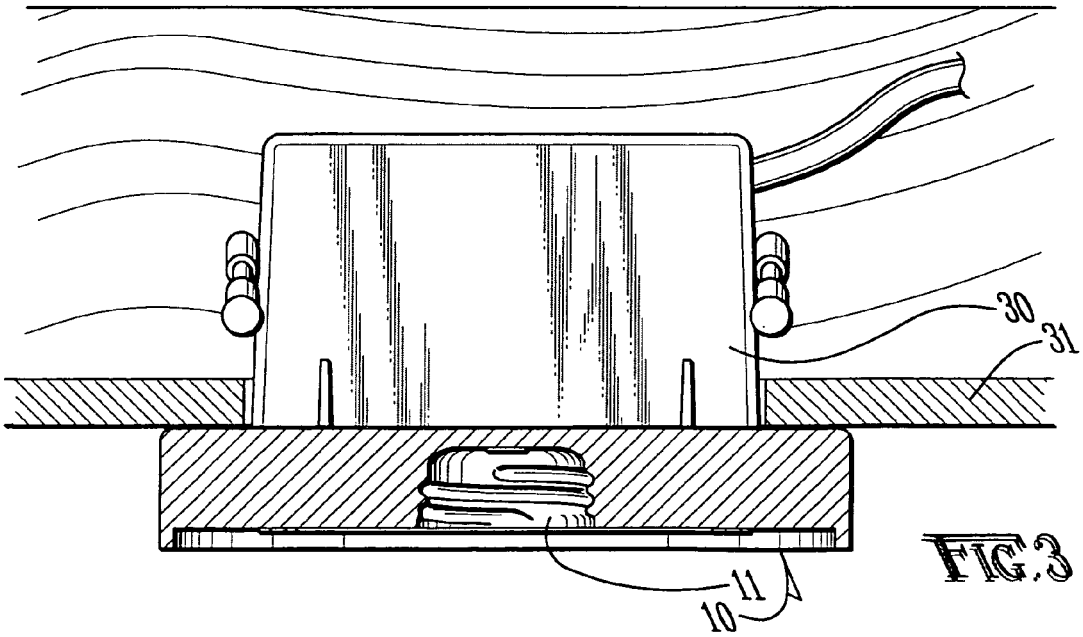
FIG. 3 is a cross sectional elevation view of the base of the embodiment of FIG. 1.
Figure 4:
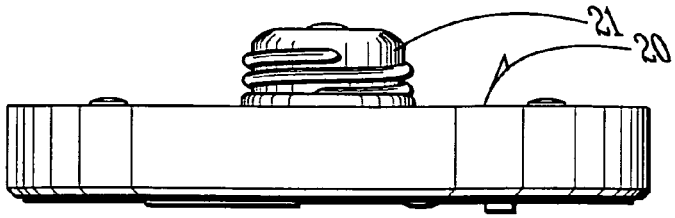
FIG. 4 is an elevation view of the body of the embodiment of FIG. 1.
Figure 5:
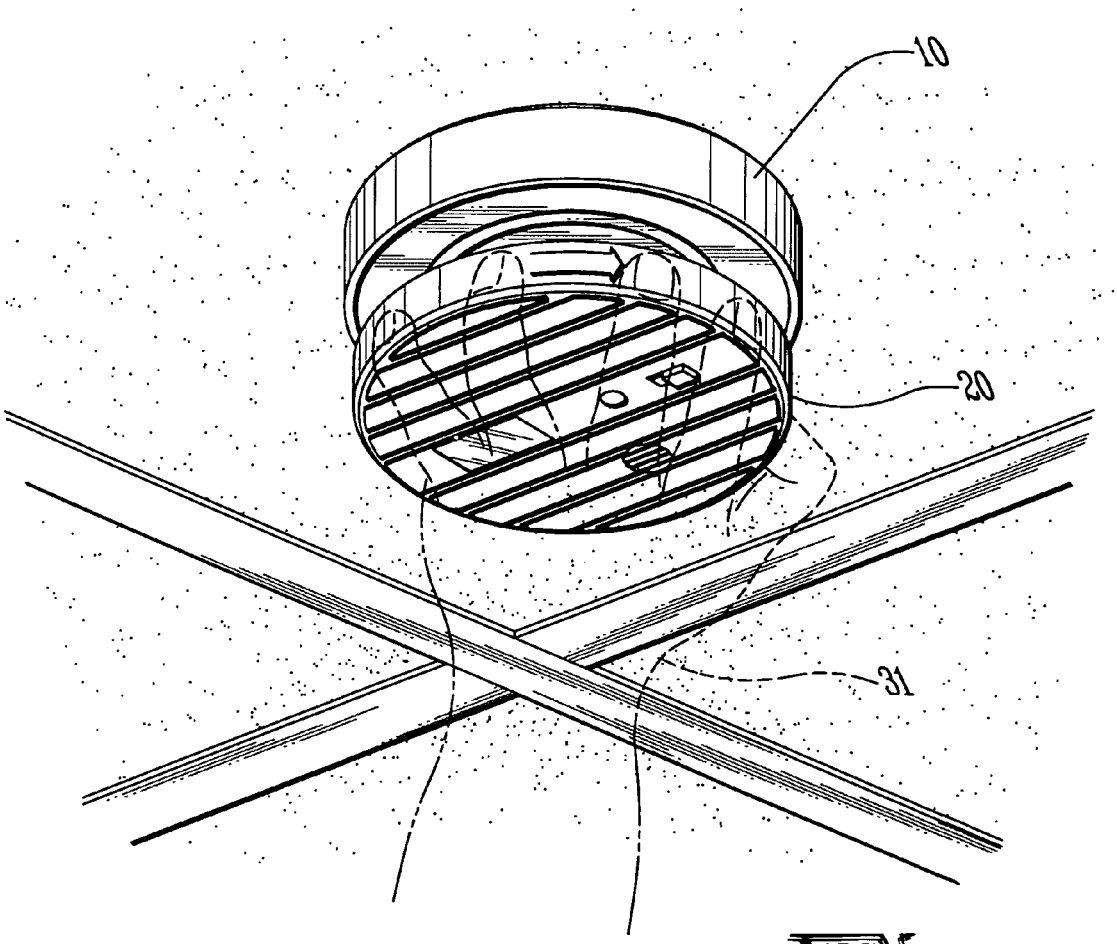
FIG. 5 is a perspective view of a user assembling the body of the embodiment of FIG. 1 into the base.
Figure 6:
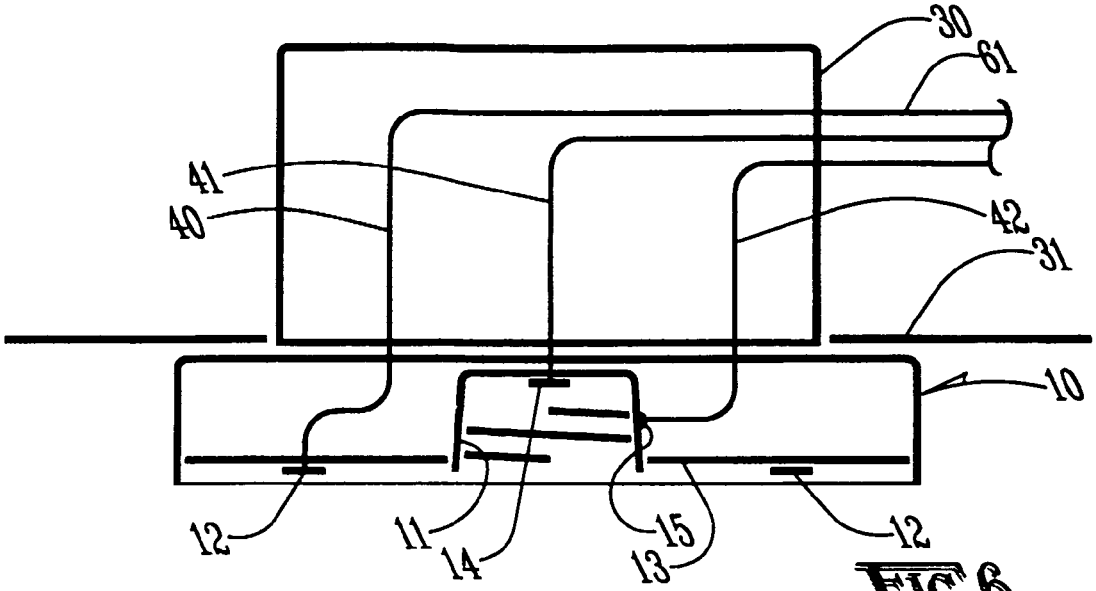
FIG. 6 is a cross sectional elevation schematic of the base showing electrical connections.
Figure 7:
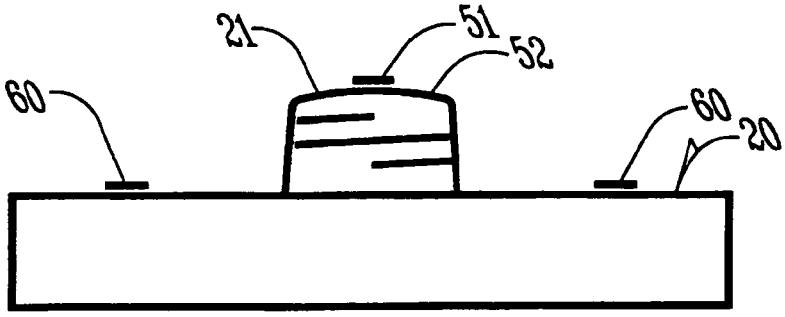
FIG. 7 is a cross sectional elevation schematic of the body showing electrical connections.
Figure 8:
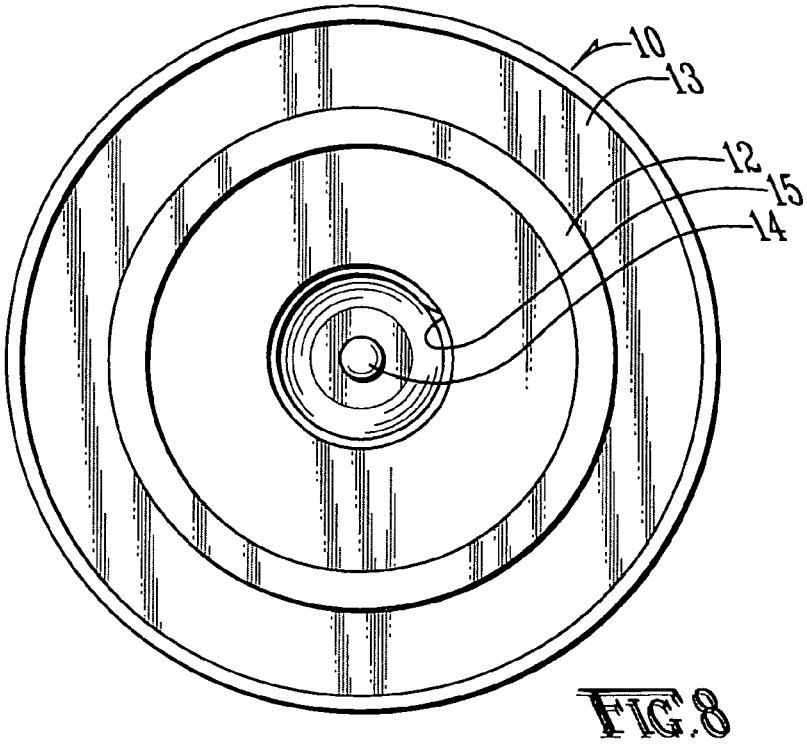
FIG. 8 is plan view of the lower side of the base.
Figure 9:
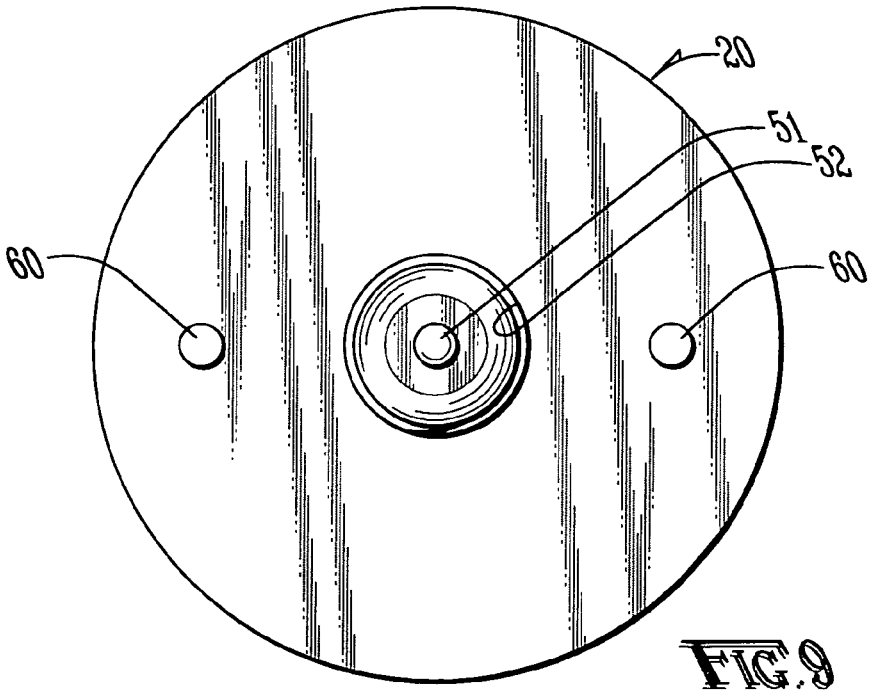
FIG. 9 is a plan view of the upper side of the body.
Figure 10:
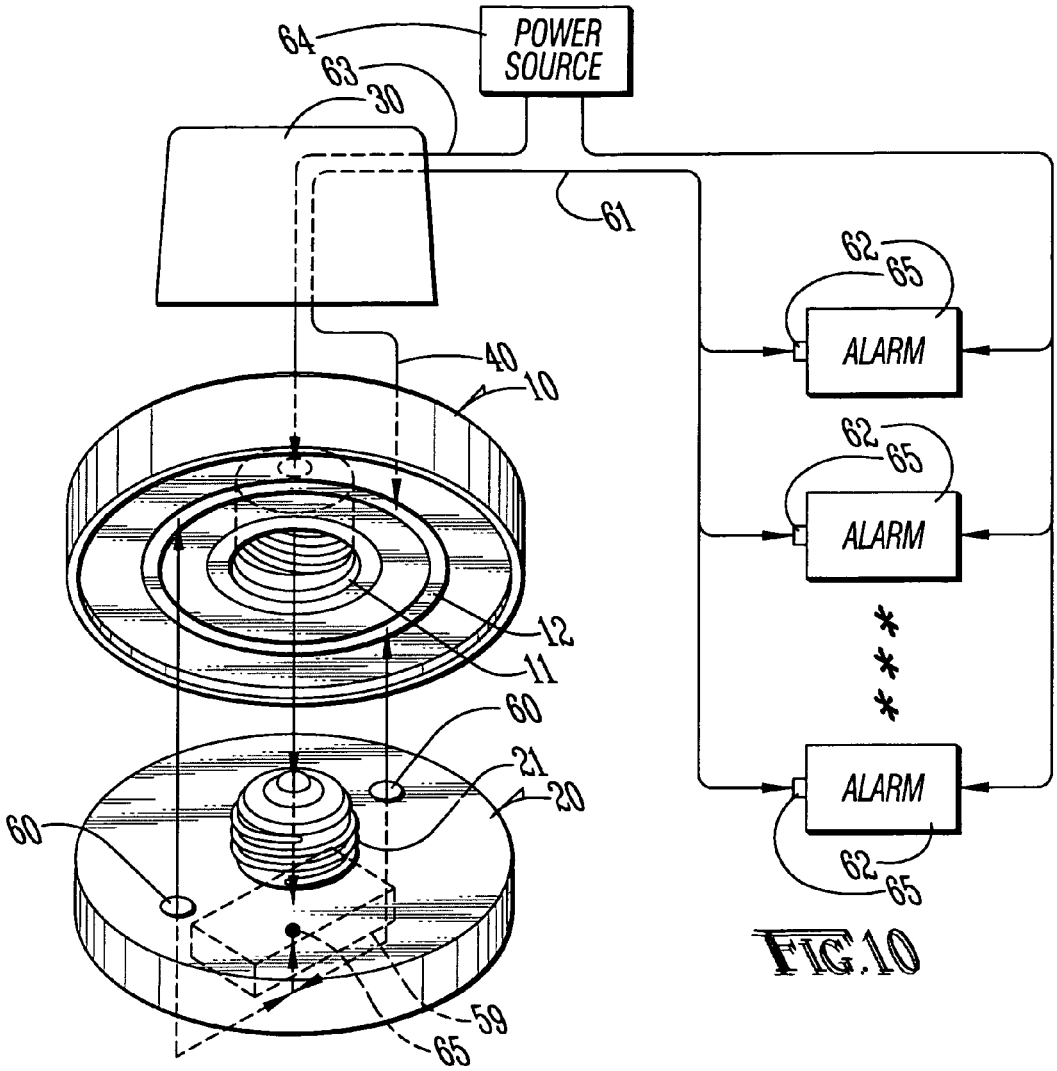
FIG. 10 is an electrical schematic of one embodiment of a smoke alarm system of the present invention.

With reference to FIGS. 1-10, the preferred embodiments of the present invention may be described. The present invention is a smoke alarm system comprising a base 10 and a body 20. The base 10 is mounted onto and electrically connected to a standard electrical makeup box 30. The mounting of the base 10 to the electrical makeup box 30 may be by any of various means that would be well known to those skilled in the art. In typical practice, the electrical makeup box 30 would be mounted flush to the ceiling 31 and the base 10 would in this case extend below the ceiling 31. The electrical makeup box 30 is connected to an unswitched circuit 63. In order words, electrical power is supplied continuously to the base 10 and cannot be inadvertently switched off, thereby defeating the alarm function. Herein the term "unswitched circuit" means that the circuit providing power between the power panel 64 and the electrical box 30 is not provided with means, other than a circuit breaker or similar emergency or safety device, to interrupt the service of electrical power through the circuit. Both the base 10 and the body 20 are desirably in the size and shape of conventional smoke alarms, that is, a flattened cylindrical shape with a diameter greater than a height of either the base 10 or the body 20. The body 20 contains conventional smoke or heat alarm circuitry 59, including a point of connection 65 to an interconnect wire 61 as described below.

The base 10 has a threaded female socket 11 similar to a standard light bulb socket disposed on a lower side of the base 10. The body 20 contains a corresponding male threaded connector 21 similar to that on a standard light bulb disposed on an upper side of the body 20. The body 20 is thus able to be electrically connected to as well as physically mounted to the base 10 by simply screwing the male threaded connector 21 into the female threaded socket 11 in the same manner as a light bulb is screwed into a light socket. The present invention can therefore be serviced as easily as changing a light bulb. However, the threaded connection used with the present invention need not be the same size as a standard light bulb socket.

There is a conductive metal ring 12 on a shoulder 13 located on the lower side of the base 10. The ring 12 is electrically connected to a wire 40 that extends into the electrical box 30 and ties into the smoke alarm interconnect wire 61. The interconnect wire 61 ties all other alarms 62 in a building together so that when one alarm is triggered, all the alarms 62 in the interconnected system sound a warning. Each alarm 62 has a respective interconnect point of connection 65 operatively connected to its respective alarm circuitry.

The female threaded socket 11 is electrically connected through the electrical box 30 into the unswitched circuit 63 of the building's electrical power system to provide standard 120 volt AC 41 and neutral 42 to the smoke alarm in the same manner a light bulb is provided power. The AC 41 is provided by an electrical connection to a button connector 14 on the top of the female socket 11 while the neutral 42 is provided by an electrical connection to the threaded wall 15 of the female socket 11. The male connector 21 screws into the female socket in the same manner as a light bulb receiving its AC power and neutral in the same manner as a standard light bulb. The AC power is received through an electrical connection made by a corresponding button connector 51 on the top of the male connector 21 by contact with the button connector 14 on the female socket 11. The neutral connection is made through electrical connection between the side wall 15 of the female socket 11 and the side wall 52 of the male connector 21. The button connector 51 and the sidewall 52 are electrically connected to the alarm circuitry thereby providing electrical power to the alarm circuitry when the body 20 is installed into the base 10. The alarm circuitry 59 may also include a battery backup (not shown), such as a common 9 volt non-rechargeable battery, for situations when the building power fails, but the present invention does not require a rechargeable battery since the electrical power to the system is not switched.

Disposed on an upper side of the body 20 are metal spring-loaded tabs 60 which are electrically connected with the interconnect point of connection 65 of the smoke alarm circuitry 59 within the body 20. As the body 20 is screwed into the female socket 11, the tabs 60 make connection with the metal ring 12 on the shoulder 13 of the base 10 completing the connection to the interconnect circuit 61 of the alarm system. While the electrical connection with the interconnect circuit 61 may be made with only one tab 60, it is preferable that there are two tabs 60 spaced equidistantly on the body 20 to ensure a good electrical connection and to balance the body 20 as it is screwed into the base 10. Each tab 60 is desirably in the shape of a horseshoe and is spring-loaded toward the metal ring 12 so as to keep pressure on the connection between the body 20 and the base 10 when they are screwed together. Since the ring 12 is a continuous circle of conductive metal the electrical connection will be completed regardless of where the body 20 is seated and ceases to turn further.

Once the dimensions of the smoke alarm are known a device with a handle, similar to well-known light bulb changers, may be used to remove and reinstall the body 20 while standing on the floor.

The preferred embodiments of the present invention are described with reference to a smoke alarm, but the present invention is not so limited and may include other types of alarms, such as heat or carbon monoxide detectors. Any use of the term "smoke detector" herein is intended to encompass all other types of detector and alarm systems. The present invention may be manufactured in various sizes and shapes and in various materials and is not limited to the particular sizes, shapes and materials described herein.

The present invention has been described with reference to certain preferred and alternative embodiments that are intended to be exemplary only and not limiting to the full scope of the present invention as set forth in the appended claims.

What is claimed is:

1. A smoke alarm system, comprising:

an electrical makeup box;

an unswitched electrical power circuit provided to said electrical makeup box;

a base having means for physically mounting to said electrical makeup box, said base comprising a lower side having a threaded female socket disposed thereon and electrically connected to said electrical makeup box; and a body comprising a smoke alarm circuit, said body further comprising a threaded male connector disposed on an upper side of said body and having threads corresponding to said threaded female socket, said threaded male connector being electrically connected to said smoke alarm circuit;

said threaded female socket and said threaded male connector having means for electrically connecting said female socket to said male connector when said male connector is screwed into said female socket.

2. The smoke alarm system of claim 1, further comprising an interconnect system;

wherein said base comprises an electrically conductive ring electrically connected to said interconnect system and disposed on a shoulder on said lower side of said base; and wherein said body comprises an electrically conductive tab electrically connected to an interconnect circuit of said smoke alarm circuit and disposed on an upper side of said body such that electrical contact is made between said ring and said tab when said male connector is screwed into said female socket.

3. A smoke alarm system, comprising:

an electrical makeup box;

a base having means for physically mounting to said electrical makeup box, said base comprising a lower side having a threaded female socket disposed thereon and electrically connected to said electrical makeup box; and a body comprising a smoke alarm circuit, said body further comprising a threaded male connector disposed on an upper side of said body and having threads corresponding to said threaded female socket, said threaded male connector being electrically connected to said smoke alarm circuit;

said threaded female socket and said threaded male connector having means for electrically connecting said female socket to said male connector when said male connector is screwed into said female socket; and further comprising an interconnect system;

wherein said base comprises an electrically conductive ring electrically connected to said interconnect system and disposed on a shoulder on said lower side of said base; and wherein said body comprises an electrically conductive tab electrically connected to an interconnect circuit of said smoke alarm circuit and disposed on an upper side of said body such that electrical contact is made between said ring and said tab when said male connector is screwed into said female socket.

* * * * *